US006367303B1

(12) United States Patent
Hizono

(10) Patent No.: US 6,367,303 B1
(45) Date of Patent: Apr. 9, 2002

(54) WHEEL REPAIRING APPARATUS

(75) Inventor: Toshihiro Hizono, Chiba (JP)

(73) Assignee: Tsubasa System Co., LTD, Tokyo (JP)

( * ) Notice: Subject to any disclaimer, the term of this patent is extended or adjusted under 35 U.S.C. 154(b) by 0 days.

(21) Appl. No.: 09/641,712

(22) Filed: Aug. 21, 2000

(30) Foreign Application Priority Data

Jan. 14, 2000 (JP) ..... 2000-010202

(51) Int. Cl.[7] ..... B21D 41/02
(52) U.S. Cl. ..... 72/316; 29/283.5; 29/402.21
(58) Field of Search ..... 72/316; 29/281.6, 29/283.5, 402.19, 402.21; 254/50.3; 269/48.1

(56) References Cited

U.S. PATENT DOCUMENTS 4,074,408 A * 2/1978 Davis ..... 29/894.322
5,499,524 A * 3/1996 Len ..... 72/316

* cited by examiner

*Primary Examiner*—P. W. Echols
(74) *Attorney, Agent, or Firm*—Arent Fox Kintner Plotkin & Kahn PLLC

(57) ABSTRACT

To readily perform a repairing work for a deformed portion of a rim without any adverse effects given by a rim shape of a wheel or a kind of the wheel, and to enhance the precision of the repairing work and the simplification of the apparatus by devising a receiver for a reactive force of a pressing jack, a wheel repairing apparatus includes a base (2) on which the wheel H is to be mounted with its axis vertical, a support frame (3) provided on the base, supporting means (A) provided between the support frame and the base for rotatably supporting the wheel about the vertical axis and pressurizing means (B) for pressurizing the deformed portion of the rim (R). The pressurizing means includes a pressurizing lever (7) having a free end (6) swingably rotatable about a proximal end (5) for pressurizing the free end to be brought into contact with the deformed portion of the rim from inside, and a jack (8) for applying to the pressurizing lever a force in a direction in which the deformed portion is returned to the original form. A reactive force of the jack is received by the wheel supporting means (A).

7 Claims, 6 Drawing Sheets

WHEEL REPAIRING APPARATUS

BACKGROUND OF THE INVENTION

1. Field of the Invention

The present invention relates to a wheel repairing apparatus and a wheel repairing method for repairing a deformed portion of a rim of a wheel that is damaged due to an accident and the like to be returned to the original form.

2. Description of the Related Art

Conventionally, a wheel made of steel has frequently been used as a wheel on which a tire is mounted in a vehicle or the like. Recently, however, a wheel made of lightweight aluminum or magnesium has frequently been used. Since it is a light alloy, it contributes to improve acceleration, riding feeling and fuel efficiency, and provides an excellent aesthetic design, but it has a weak point that a rim of the wheel is likely to be deformed or damaged due to the contact caused by an accident or the like.

In the case where this rim of the wheel is subjected to damage to such an extent of only a deformation, it is uneconomical to dump the wheel, and the technology to repair this for reuse has conventionally been developed. For example, this technology is shown in, for example, Japanese Utility Model Publication No. Hei 3-9853 and Japanese Utility Model Publication No. Hei 6-21802.

In the technology disclosed in Japanese Utility Model Publication No. Hei 3-9853, an elevator frame that is movable up and down is provided above a table on which a tire wheel is fixed with its axis vertical, a pair of press rods are coupled by pins at their upper ends to a bottom surface of the elevator frame, and attachments are provided at the respective lower ends so as to come into contact with inner circumferential surfaces of the tire wheel. Then, one of the attachments is brought into contact with the inner surface of the recessed deformed portion of the rim, and the other attachment is brought into contact with the rim portion opposing the deformed portion of the rim in a diametrical line of the tire wheel. The elevator frame is lowered so that the recessed deformed portion is pressed by one of attachments to repair it.

However, such a conventional tire wheel repairing apparatus has the following disadvantages because it has a structure including the two attachments.

A first problem is that it is impossible to use the repairing apparatus according to a kind of wheels to be repaired. Namely, it is the problem of a size of the attachment. The other attachment that serves as a receiver for the reactive force of one attachment needs to have a length of one third or more of the tire wheel diameter for its function. For this reason, there is a problem that it is impossible to secure a space for mounting the other attachment according to a kind of wheels that are different in shape of the rim portion or the disc portion due to the various designs.

A second problem is that, in the method of thus using the other attachment as the reactive force receiver, when the other attachment is designed in a small size in the same manner for one attachment, the wheel is, inversely, deformed due to the other attachment.

A third problem is that, when the deformed portion of the rim caused by the damage is to be repaired, in many cases, simply pressing the deformed portion by means of the attachment cannot repair it to a sufficient level. Namely, if the deformation is small, it is relatively easy to perform the repairing work, but if the deformation is large, it is necessary to apply a large force for repairing the wheel. Thus, it is necessary to take some measures to deal with such situation.

In this respect, according to the technology disclosed in Japanese Utility Model Publication No. Hei 6-21802, the reactive force receiver is formed in an inverted U-shaped support frame portion provided on the base. However, this causes a problem that not only the apparatus should become large and bulky since i requires a plurality of rim repairing cylinders, but also the eccentric force is applied to the wheel itself because the wheel is not used as the reactive force receiver. For this reason, the technology is not suitable for the repairing work with high precision and the workability is also degraded.

SUMMARY OF THE INVENTION

Accordingly, an object of the present invention is to provide a wheel repairing apparatus and a wheel repairing method that may readily repair the deformed portion of the rim without receiving any adverse effect from a rim shape, a disc shape and a kind of a wheel which vary by a design and the like, and, in addition, may enhance the precision of the repairing work and simplify the apparatus by devising a reactive force receiver for a pressurizing jack and positioning an axis of the wheel.

According to the present invention, there is provided a wheel repairing apparatus for repairing a deformed portion of a rim of a wheel caused by damage and the like, comprising: a base on which the wheel is to be mounted with its axis vertical; a support frame provided on the base; supporting means provided between the support frame and the base for rotatably supporting the wheel about the vertical axis; and pressurizing means for pressurizing the deformed portion of the rim; wherein the pressurizing means includes a pressurizing lever having a free end swingable about its proximal end, and at least the free end is brought into contact with the deformed portion of the rim from inside, and a jack for applying to the pressurizing lever a force in a direction in which the deformed portion is returned to the original form, and a reactive force of the jack is received by the wheel supporting means.

The pressurizing lever having the free end that is swingable about its proximal end is provided whereby it is possible to bring the pressurizing lever into contact with the deformed portion of the rim from inside precisely. Then, since the free end is thus swingable, it is easy to apply the force, in a direction in which the deformed portion of the rim is returned to the original form, by pushing the pressurizing lever by the jack. Also, with the structure for receiving the reactive force of the jack by the supporting means of the wheel, there is no fear that the eccentric force is given to the entire wheel or the portion of the rim. Thus, it is possible to perform the repairing work with high precision.

According to the present invention, it is possible to adopt a structure wherein a support member extending in a radial direction of the wheel is provided in an upper position of the wheel, the proximal end of the pressurizing lever is arranged movably and positionably along the support member, and a hinge for making the free end vertically rotatable along the radial direction of the wheel is provided at the proximal end portion of the pressurizing lever.

Thus, it is possible to move the pressurizing lever in its entirety in the radial direction of the wheel and it is possible to rotate the free end of the pressurizing lever vertically along the radial direction of the wheel about the hinge. Accordingly, it is possible to deal with the case where a diameter of a wheel, a rim thickness, a wheel width and the like are different, with ease and high precision.

The support frame may be configured to have a horizontal support frame extending in the radial direction of the wheel, and the support member of the pressurizing lever is fixed to the horizontal support frame. Thus, the support member is an independent member. Thus, it is possible to simplify the structure in which the proximal end of the pressurizing lever may be made movable and positionable by using a screw rod and the like as the support member.

It is preferable that the wheel supporting means includes a lower support unit for supporting the wheel from below, and an upper support unit for pressing the wheel from above to support the wheel, and the lower support unit has a support shaft extending vertically from a top surface of the base and movable up and down, and a receiver member with its lower end coupled with the support shaft and its upper end supports a lower surface of a periphery of a hub of the wheel. Thus, it is possible to hold the wheel with its axis in vertical position and to support the wheel rotatably on the base.

It is preferably that the upper support unit comprises a cylinder having a pressing member to be inserted coaxially into the hub hole of the wheel from above for alignment of the center and a rod supported vertically in the support frame and extending in an up-and-down direction, the cylinder presses the pressing member coaxially from above by the rod; and a height adjustment member disposed coaxially between the rod of the cylinder and the pressing member. Thus, with such configuration, it is possible to support the wheels that are different in kind in an easier and more accurate manner.

It is preferable that the rod of the upper support unit is supported by the horizontal support frame, both ends of the horizontal support frame are supported movably up and down with respect to the support frame, and both ends of the horizontal support frame are biased upwardly by springs. With such configuration, it is possible to move the rod up and down while keeping the perpendicularity of the rod and in addition to move the horizontal support frame smoothly up and down by the action of the springs.

Also, it is preferable that the jack is detachably mounted between the pressurizing lever and the upper support unit. Thus, it is possible to take a form that the reactive force of the jack may be received by the upper support unit for supporting the wheel with pressing thereof from above.

On the other hand, a method of the present invention is a wheel repairing method for repairing a deformed portion of a rim of a wheel caused by damage and he like by using a wheel repairing apparatus with pressurizing means for pressurizing the deformed portion, comprising the steps of: pressurizing the deformed portion of the rim from inside thereof by the pressurizing means in a direction in which the damaged portion is returned to the original form; and heating the deformed portion of the rim from outside thereof; wherein the heating is performed during the pressurizing process.

In the case where such a method is adopted, in the repairing work of the deformed portion of the rim, the heating is performed during the pressurizing process so that the deformed portion may readily be repaired. A gas burner or the like may be used for heating.

Also, it is preferable that the heating s performed while adjusting a force for pressurizing the deformed portion by the pressurizing means. This is because the repairing work can be performed while adjusting the extent of repairing the deformed portion and the repairing speed so as to prevent the problem of excessive heating or over pressurizing. Thus, it is possible to repair the deformed portion with high precision.

DESCRIPTION OF THE PREFERRED EMBODIMENTS

Preferred embodiments of the present invention will now be described with reference to the accompanying drawings.

Figure 1:
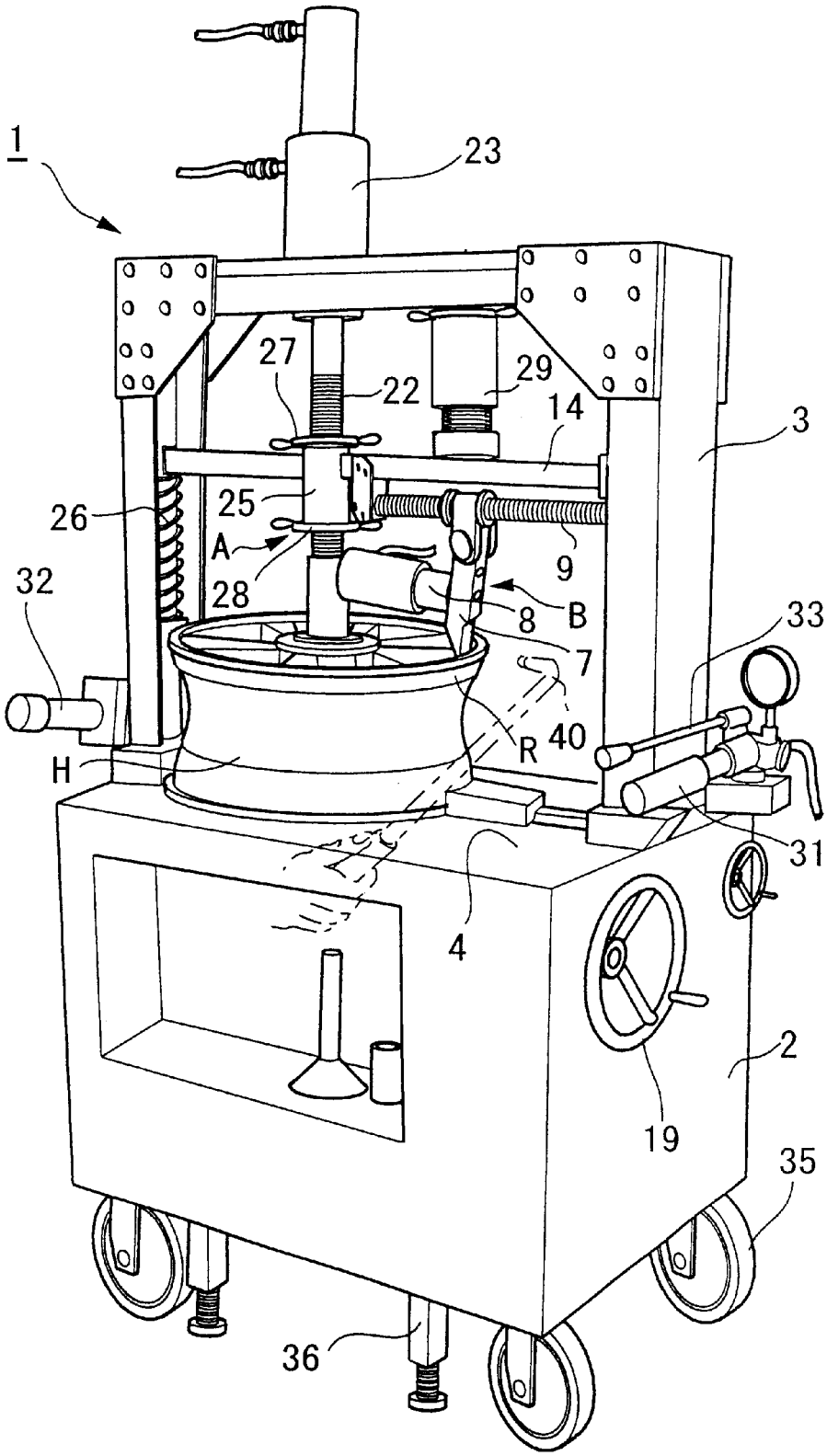
FIG. 1 is a perspective view of a wheel repairing apparatus in accordance with an embodiment of the present invention.
Figure 2:
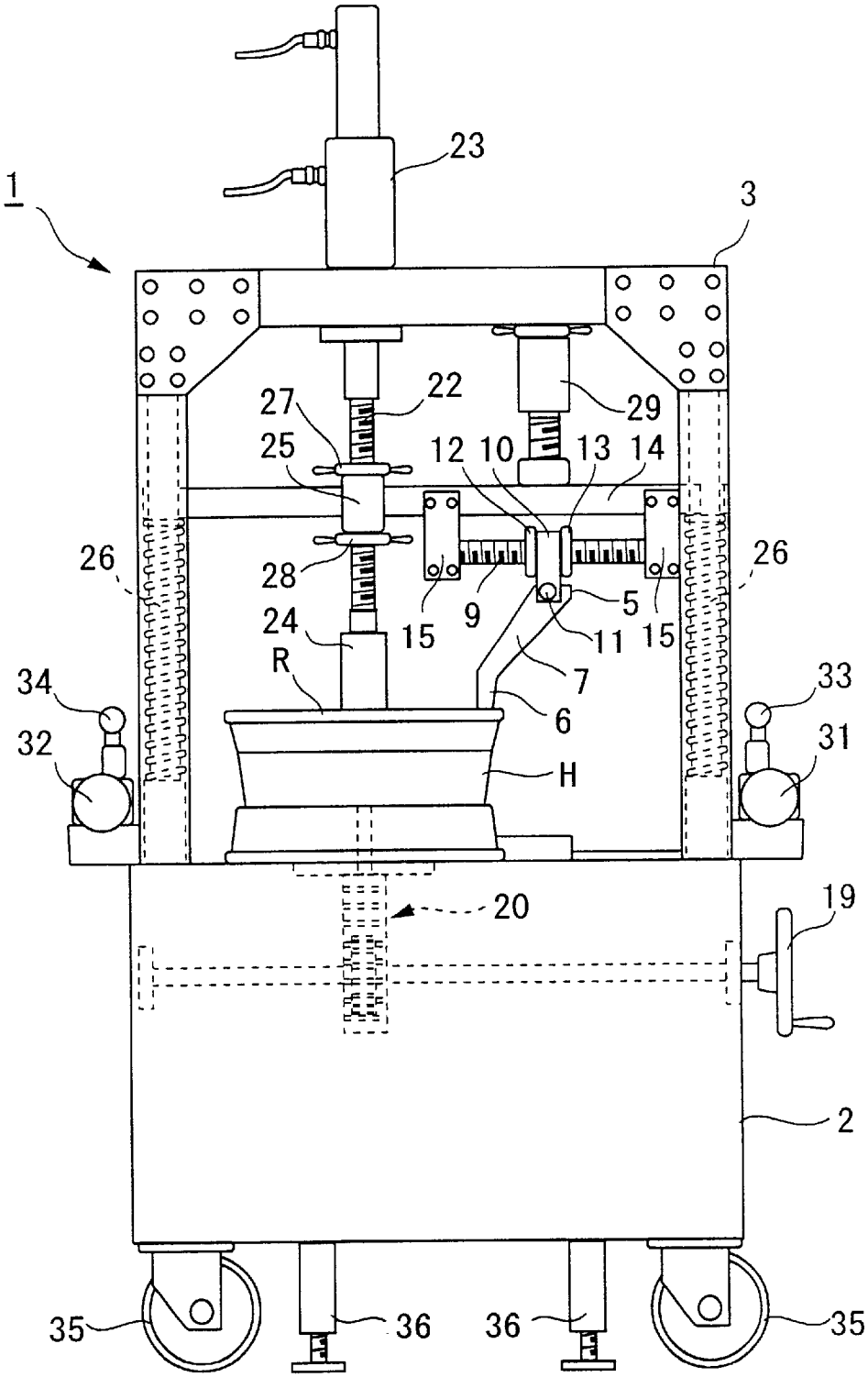
FIG. 2 is a front view of the wheel repairing apparatus in accordance with the embodiment of the present invention.

FIGS. 1 and 2 are a perspective view and a front view showing an example in which the present invention is applied to an aluminum wheel repairing apparatus of an automotive vehicle.

In FIGS. 1 and 2, reference numeral 1 denotes a wheel repairing apparatus including a base 2 having a suitable height which is convenient for the standing work and a support frame 3 in an inverted U-shape provided on the base 2. A top surface 4 of the base 2 is a horizontal plane, on which a wheel H that needs a repair may be mounted rotatably on the top surface 4 with its axis vertical.

Supporting means A for supporting the wheel H rotatably about a vertical axis thereof and pressurizing means B for pressurizing the deformed portion of the rim are provided between the support frame 3 and the base 2. The pressurizing means B has a pressurizing lever 7 having a free end 6 that is swingable about an upper proximal end 5 for pressurizing the deformed portion of the rim from inside, and a jack 8 for applying a force to the pressurizing lever 7 in a direction in which the deformed portion is returned to the original form.

A screw rod (support member) 9 extending in a radial direction of the wheel H is provided in the upper position of the wheel H. The proximal end 5 of the pressurizing lever 7 is provided movably and positionably along the screw rod 9. In this example, the proximal end 5 of the pressurizing lever 7 is hinge-connected through a pin 11 to a slide member 10 fitted over the screw rod 9. Thus, the free end 6 of the pressurizing lever 7 is vertically rotatable (swingable) along the radial direction of the wheel H. A pair of fastening nuts 12 and 13 is provided on both sides of the slide member 10 so that positioning and horizontal movement of the slide member 10 may be adjusted.

The support frame 3 is provided with a horizontal support frame 14 extending in the radial direction of the wheel H. Both ends of the screw rod 9 serving as a support member of the pressurizing lever 7 are fixed to the horizontal support frame 14 by coupling members 15 and 15.

Figure 3:
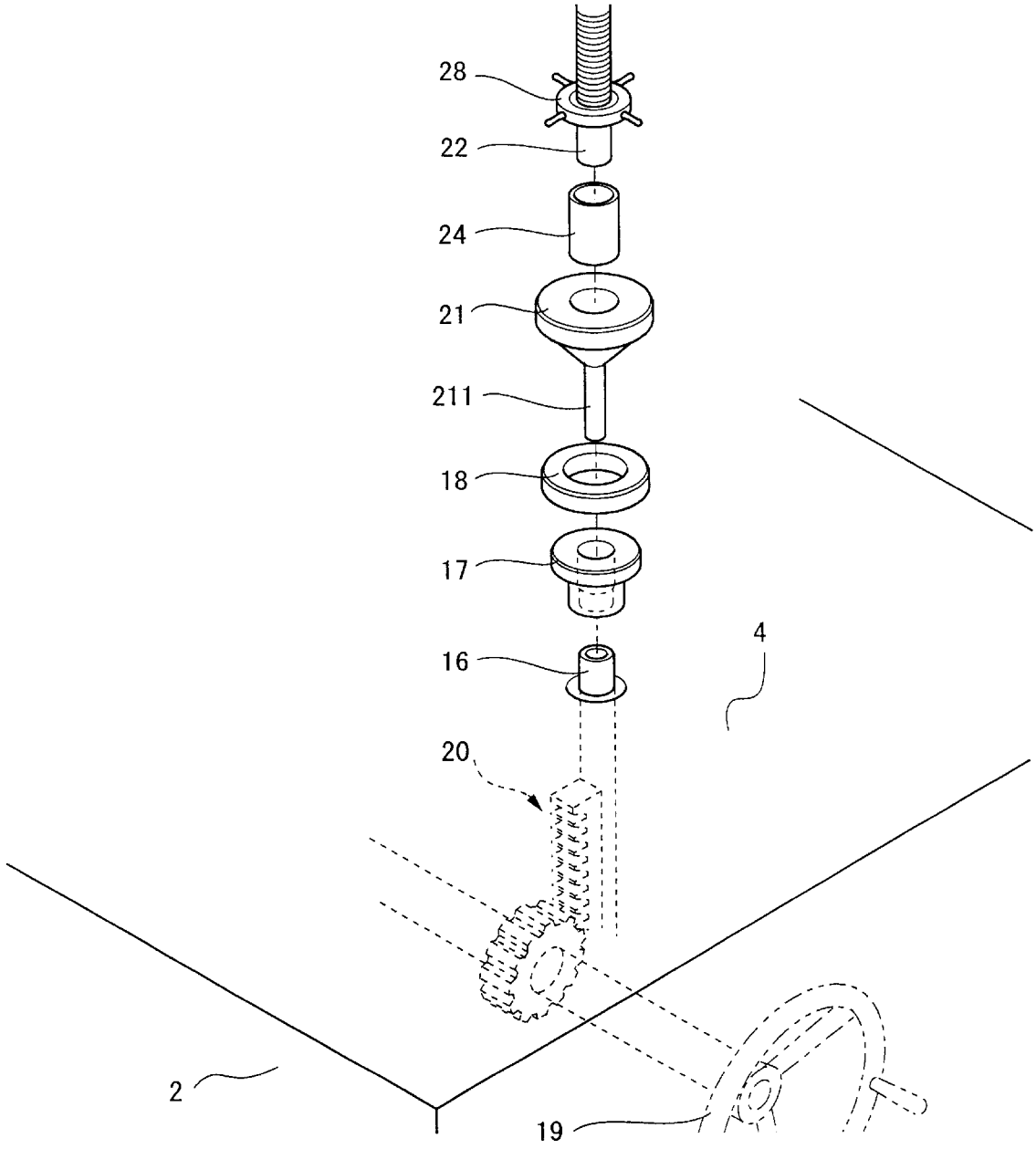
FIG. 3 is an exploded perspective view of the essential portion of wheel supporting means according to the embodiment of the present invention.
Figure 4A:
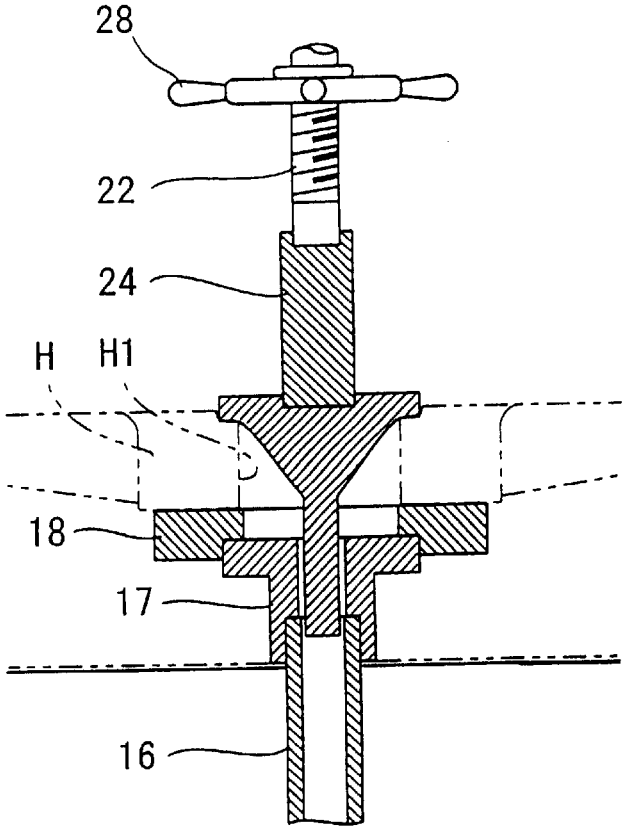
FIGS. 4(*a*) and 4(*b*) are sectional views showing the wheel supporting means in accordance with the embodiment of the present invention, wherein FIG. 4(*a*) is a sectional view of a set condition and FIG. 4(*b*) is a sectional view of an exploded condition.
Figure 4B:
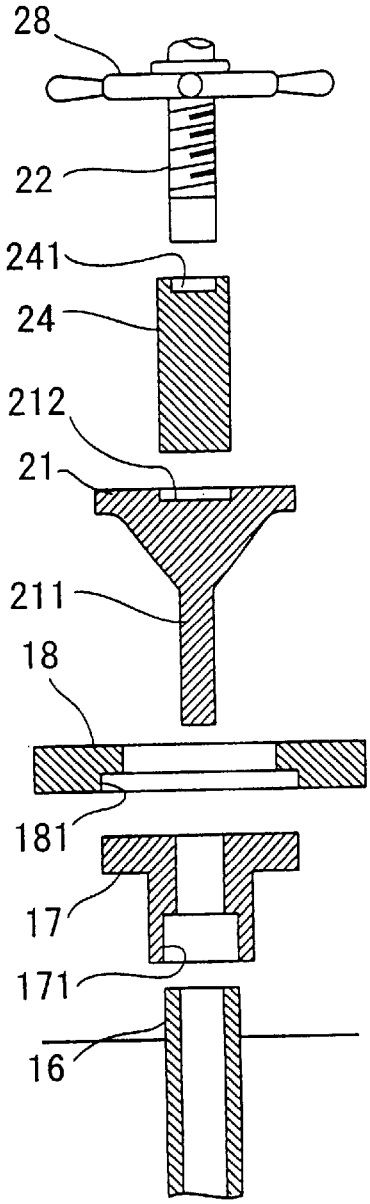

The supporting means A for supporting the wheel H with its axis vertical comprises a lower support unit for supporting the wheel H from below and an upper support unit for pressing the wheel H from above to support thereof. As shown in FIG. 3, the lower support unit is provided with a support shaft 16 extending vertically from the top surface 4 of the base 2 and movable up and down, a first receiver member 17 with its lower end mounted on the support shaft 16 and with its upper end supports a lower surface around a hub hole H1 of the wheel, and a second receiver member 18 mounted on the upper portion of the first receiver member 17. As shown in FIGS. 4(*a*) and 4(*b*), the first receiver member 17 and the second receiver member 18 are so configured to be mounted detachably and coaxially by utilizing recesses 171 and 181 provided in the respective members.

The support shaft 16 is moved up and down through a conversion gear 20 for translating the rotation of a handle 19 provided on a side surface of the base 2 into the vertical movement. Another mechanism having the same function may be used as the conversion gear 20. For example, a combination of a worm gear, a screw rod and a nut may be used. In any case, it is preferable to use a structure in which the support shaft 16 is movable up and down and the support shaft 16 cannot be lowered unless the handle 19 is rotated.

The upper support unit is provided with a cylinder 23 having a pressing member 21 to be inserted into the hub hole H1 of the wheel H coaxially from above for alignment of the center and a rod 22 being supported vertically by the support frame 3 and extending in the vertical direction, the cylinder 23 presses coaxially the pressing member 21 from above by the rod 22; and a height adjustment member 24 disposed coaxially between the rod 22 of the cylinder 23 and the pressing member 21.

The pressing member 21 has a shaft rod 211 extending downwardly. This shaft rod 211 has a length that reaches the interior of the support shaft 16 through the second and first receiver members 18 and 17. Thus, this shaft rod 211 is also configured to align the axis of each member. A recess 212 is provided in the top surface of the pressing member 21 and a lower portion of the adjustment member 24 is fitted thereinto. A recess 241 is provided in the top surface of the adjustment member 24 and the lower portion of the rod 22 is fitted thereinto. Thus, the respective members are coupled with each other in a detachable manner and coaxially.

Figure 5:
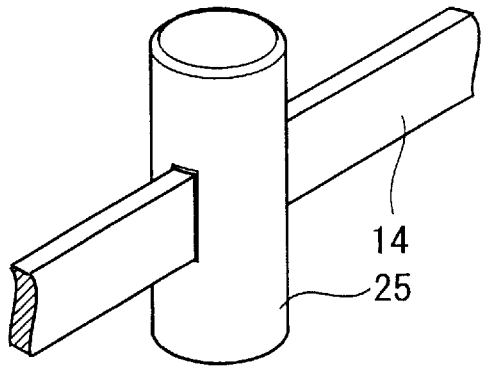
FIG. 5 is a perspective view showing a coupling member and a horizontal support frame in accordance with the embodiment of the present invention.

Also, as shown in FIG. 5, the rod 22 of the upper support unit is supported through a coupling member 25 to the horizontal support frame 14. Both ends of the horizontal support frame 14 are supported movably up and down to the support frame 3. Furthermore, both ends of the horizontal support frame 14 are biased upwardly by coil springs 26 and 26 contained in the support frame. Thus, the apparatus is designed so that the rod 22 may be moved up and down while holding the verticality of the rod 22, and in addition, the horizontal support frame 14 may be smoothly moved up and down by the action of the coil springs 26.

An upper fastening nut 27 and a lower portion fastening nut 28 for fine adjustment are provided at an upper portion and a lower portion of the coupling member 25, respectively. These fastening nuts 27 and 28 are screwed-in by a portion of the rod 22 as the screw rod. Both fastening nuts 27 and 28 make it possible to adjust finely the height level of the horizontal support frame 14. A reinforcement member 29 that may adjust its stroke is provided for the purpose of reinforcing the horizontal support frame 14. This reinforcement member 29 may not be necessary when the mechanical strength of the horizontal support frame 14 is sufficient.

Figure 6:
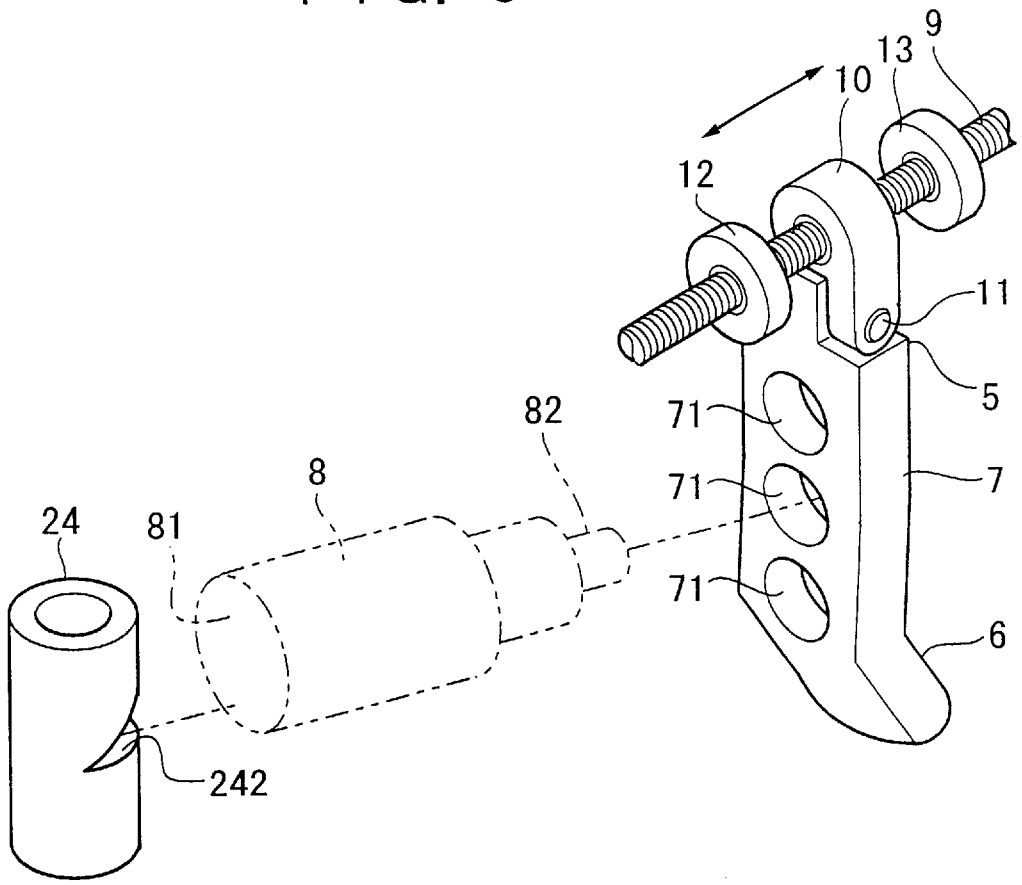
FIG. 6 is an exploded perspective view of the essential portion of the embodiment of the present invention.
Figure 7:
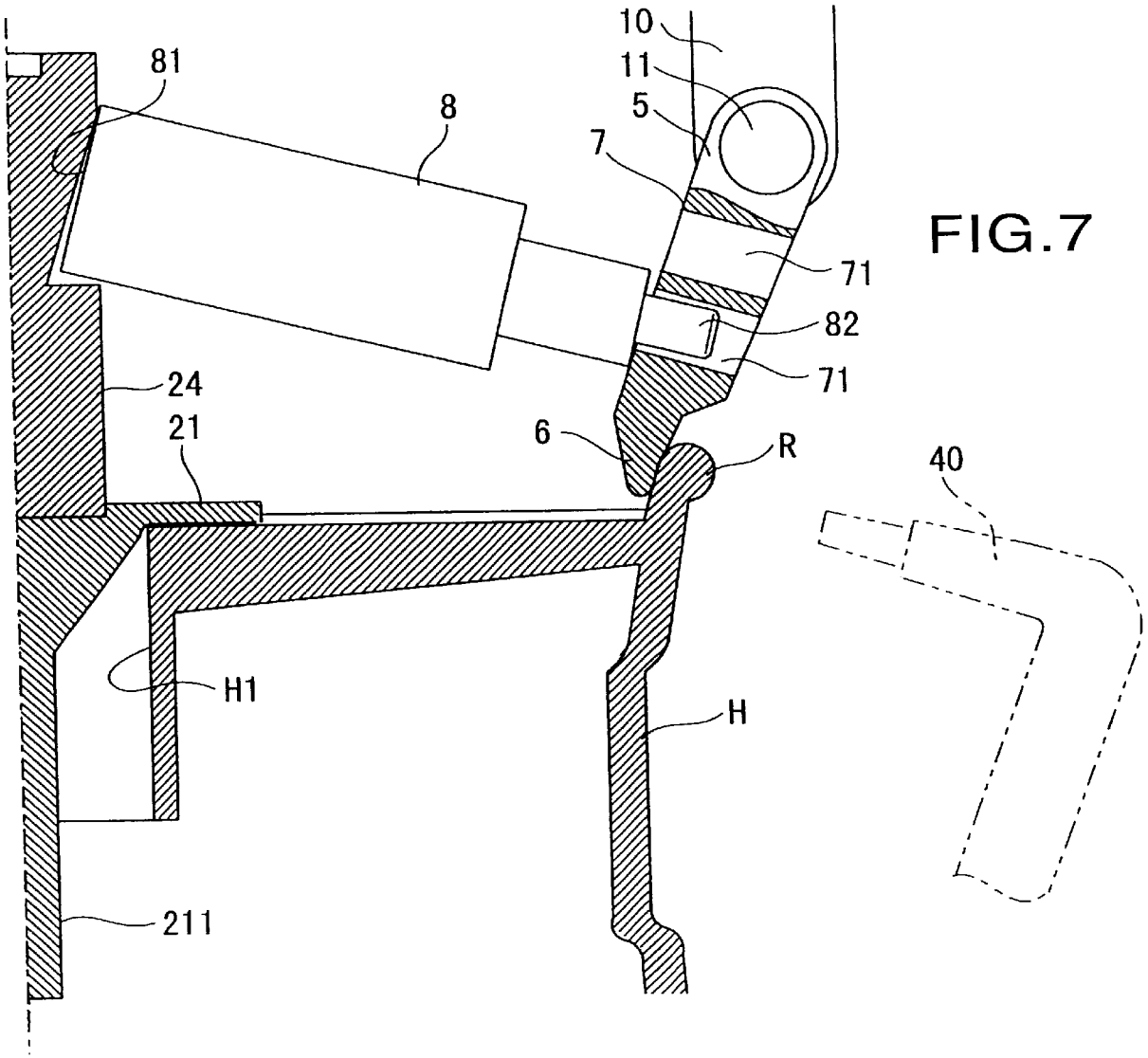
FIG. 7 is a sectional view of the essential portion of the embodiment of the present invention.

As shown in FIGS. 6 and 7, the jack 8 is detachably mounted between the pressurizing lever 7 and the height adjustment member 24 of the upper support unit. Thus, it is so configured that the reactive force of the jack 8 is received by the upper support unit which supports the wheel H by pressing it from above to support it. A slit 242 is provided in an outer circumferential portion of the adjustment member 24 and a plurality of fitting holes 71 are provided on the surface side of the pressurizing lever 7 so as to ensure the mounting of the jack 8 and to facilitate the attaching and detaching work. A proximal end 81 of the jack 8 is fitted into the slit 242 of the adjustment member 24 and a rod 82 of the jack 8 is fitted into one of the fitting holes 71 of the pressurizing lever 7.

As shown in FIGS. 1 and 2, a first hydraulic pump 31 and a second hydraulic pump 32 are provided on both sides of the base 2. The first hydraulic pump 31 feeds the jack 8 with the pressurized oil and the second hydraulic pump 32 feeds the cylinder 23 with the pressurized oil. An adjustment lever 33 for adjusting the oil pressure of the pressurized oil to be sent to the jack 8 is provided on the first hydraulic pump 31 and it also adjusts the pressure of the jack 8 to the pressurizing lever 7 as desired. A switch lever 34 is provided on the second hydraulic pump 32 so that the vertical movement of the rod 22 of the cylinder 23 may be switched. In the drawings, reference numeral 35 denotes caster wheels and reference numeral 36 denotes stoppers for preventing the movement.

When the deformed portion of the rim R of the wheel H is repaired by using the wheel repairing apparatus 1 of the above-described structure, each member is set and a pressure is applied to the deformed portion from inside of the rim R through the pressurizing lever 7 by the jack 8, as shown in FIGS. 1 and 7. When the deformation is small, it can be repaired only with the pressure of the jack 8. However, when the deformation is large, it is preferable that a gas burner 40 is used to heat the deformed portion of the rim R for repairing, as indicated by the phantom lines in FIGS. 1 and 7. Thus, it is easy to readily repair the deformed portion. Of course, this may be applied to the case where the deformation is small.

Also, when the repair is performed while heating, it is more preferable that the force for pressurizing the deformed portion by the jack 8 is adjusted during the repairing work. In this manner, the repair is performed while adjusting the extent and speed of repairing the deformed portion so that the problem of excessive heating or over pressurizing may be obviated in advance. Thus, it is possible to readily repair the deformed portion with high precision.

According to the embodiment of the present invention, the pressurizing lever 7 having the free end 6 that is swingable about the proximal end 5 is provided thereby it is possible to bring the pressurizing lever 7 into contact with the deformed portion of the rim R from inside thereof accurately. Accordingly, as exemplified in FIG. 1, even a wheel H having a number of spokes of a so-called spoke disk, it is possible to apply the pressure to the outside while inserting the free end 6 of the pressurizing lever 7 between the spokes.

Further, since the free end 6 is thus swingable, it is easy to apply the force in the direction in which the deformed portion of the rim R is returned to the original form by pressing the pressurizing lever 7 with the jack 8. Also, the reactive force of the jack 8 is received by the adjustment member 24 serving as the support means for the wheel H. Therefore, the eccentric force is no longer applied to the rim portion and the entire wheel H. Thus, it is possible to perform the repairing work with high precision.

Moreover, the pressurizing lever 7 in its entirety is movable in the radial direction of the wheel H so that the free end 6 of the pressurizing lever 7 is vertically rotatable (swingable) along the radial direction of the wheel H about the hinge 11, as desired. Accordingly, it is easy and with high precision, to deal with the case where the diameter of the wheel H, the rim thickness, the wheel width, the disc shape and the like are different.

It should be noted that, in the embodiment, the pressurizing lever 7 is vertically rotatable (swingable) in the radial direction of the wheel H about a horizontal pin (hinge portion) 11. However, it is possible to adopt a design that a degree of freedom is provided in the swing direction by constituting the hinge by a universal joint. With this structure where the free end 6 of the pressurizing lever 7 is swingable and so that the pressurizing direction of the deformed portion of the rim can be finely adjusted to meet the deformed condition.

Thus, according to the wheel repairing apparatus of the present invention, it is possible to readily repair the deformed portion of the rim without any adverse effects made by a rim shape, a disc shape and a kind of a wheel according to a design thereof, and in addition, to enhance the precision of the repairing work and simplification of the apparatus by devising a receiver for a reactive force of a pressurizing jack and positioning an axis of the wheel.

Further, according to the method of repairing the wheel of the present invention, the deformed portion of the rim is repaired while being heated so that the repairing work of the deformed portion is facilitated with high precision. Also, by performing the repairing work while adjusting the force for pressurizing the deformed portion by the jack, the repairing work can be performed while adjusting the extent and speed of repairing the deformed portion, and it is possible to prevent the problem in advance that the wheel is over heated or over pressurized. It is thus possible to repair the deformed portion more easily with higher precision.

What is claimed is:

1. A wheel repairing apparatus for repairing a deformed portion of a rim of a wheel, comprising:

a base on which the wheel is to be mounted with its axis vertical;

a support frame provided on said base;

supporting means provided between said support frame and said base for rotatably supporting the wheel about the vertical axis; and pressurizing means for pressurizing the deformed portion of said rim; and wherein said pressurizing means includes a pressurizing lever having a free end swingably rotatable about a proximal end for pressurizing at least said free end to the deformed portion of said rim from inside, and a jack for applying to said pressurizing lever a force in a direction in which said deformed portion is returned to the original form, and a reactive force of said jack is received by the wheel supporting means.

2. The wheel repairing apparatus according to claim 1, wherein a support member extending in a radial direction of the wheel, the proximal end of said pressurizing lever is provided movably and positionably along said support member, and a hinge for making said free end vertically rotatable along the radial direction of the wheel is provided at the proximal end of said pressurizing lever.

3. The wheel repairing apparatus according to claim 2, wherein said support frame includes a horizontal support frame extending in the radial direction of the wheel, and the support member of said pressurizing lever is fixed to said horizontal support frame.

4. The wheel repairing apparatus according to claim 1, wherein said wheel supporting means includes a lower support unit for supporting the wheel from below, and an upper support unit for pressing the wheel from above to support the wheel, and said lower support unit has a support shaft extending vertically from a top surface of the base and movable up and down, and a receiver member with its lower end coupled with said support shaft and with its upper end supports a lower surface of a periphery of a hub hole of the wheel.

5. The wheel repairing apparatus according to claim 4, wherein said upper support unit has a pressing member for alignment to be inserted coaxially into the hub hole of the wheel from above for alignment of the center, and a cylinder having a rod being supported vertically by said support frame and extending in an up-and-down direction, the cylinder presses coaxially said pressing member from above by said rod, and a height adjustment member disposed coaxially between the rod of said cylinder and said pressing member.

6. The wheel repairing apparatus according to claim 5, wherein the rod of said upper support unit is supported by said horizontal support frame, both ends of said horizontal support frame are supported movably up and down with respect to said support frame, and both ends of said horizontal support frame are biased upwardly by springs.

7. The wheel repairing apparatus according to claim 4, wherein said jack is detachably mounted between said pressurizing lever and said upper support unit.

* * * * *